United States Patent [19]

Hung

[11] Patent Number: 4,694,815

[45] Date of Patent: Sep. 22, 1987

[54] TOY GUNS FOR FIRING PELLETS

[75] Inventor: Lam H. Hung, Hong Kong, Hong Kong

[73] Assignee: Longreen Limited, Hong Kong, Hong Kong

[21] Appl. No.: 768,797

[22] Filed: Aug. 23, 1985

[30] Foreign Application Priority Data

Jul. 29, 1985 [GB] United Kingdom ..... 8519051

[51] Int. Cl.[4] ..... F41B 7/08; F41B 11/02

[52] U.S. Cl. ..... 124/27; 124/32; 124/39; 124/49

[58] Field of Search ..... 124/27, 29, 39, 31, 124/32, 37–38, 45–53

[56] References Cited

U.S. PATENT DOCUMENTS

| | | | |
|---|---|---|---|
| 32,619 | 6/1861 | Cutler et al. | 124/48 X |
| 194,690 | 8/1877 | Kirkbride | 124/27 |
| 1,183,133 | 5/1916 | Sperry | 124/27 |
| 1,207,669 | 12/1916 | Troubridge | 124/39 X |
| 1,231,833 | 7/1917 | Aley | 124/39 X |
| 1,830,763 | 11/1931 | Loomis | 124/52 X |
| 1,860,611 | 5/1932 | De Minno et al. | 124/49 X |
| 2,170,221 | 8/1939 | Stanley | 124/29 |
| 2,437,728 | 3/1948 | Drumheller | 124/48 |
| 2,550,887 | 5/1951 | Tratsch | 124/54 |
| 2,713,859 | 7/1955 | Bradfield | 124/45 |
| 2,836,167 | 5/1958 | Saito | 124/27 |
| 4,422,433 | 12/1983 | Milliman | 124/48 X |

FOREIGN PATENT DOCUMENTS

| | | | |
|---|---|---|---|
| 306516 | 2/1929 | United Kingdom | 124/29 |

*Primary Examiner*—Paul E. Shapiro

*Attorney, Agent, or Firm*—Vaden, Eickenroht, Thompson & Boulware

[57] ABSTRACT

A toy gun for firing pellets wherein a trigger operates a firing mechanism which reciprocates a hammer through a firing point in the gun barrel to sequentially discharge pellets therefrom. The mechanism is operated by an electric motor which reciprocates the hammer by means of a cam and follower mechanism. This mechanism successively withdraws and releases the hammer which is continuously biased in a firing mode by a spring. Also disclosed is a pellet delivery system in which a magazine is slidably mounted on the gun body enabling one of a plurality of pellet sources in the magazine to be in communication with the barrel and firing mechanism.

12 Claims, 4 Drawing Figures

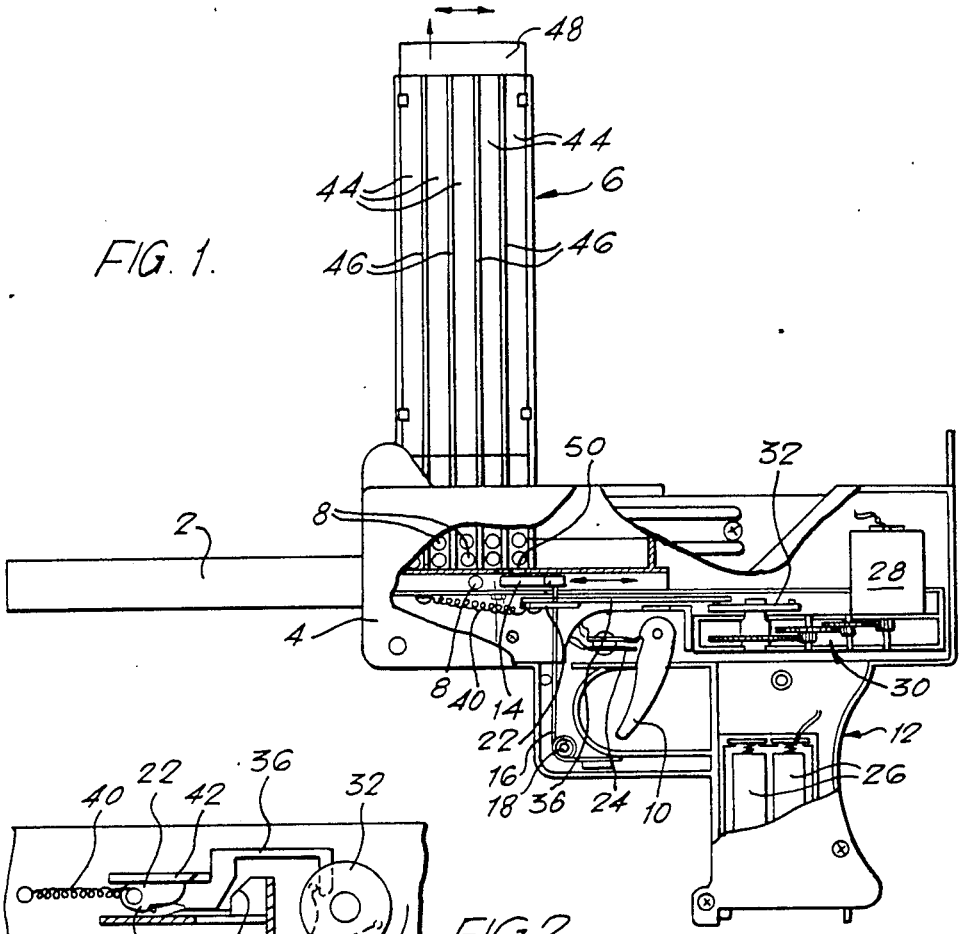
FIG. 1.
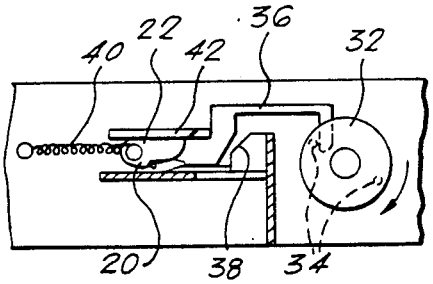
FIG. 2.
FIG. 3.
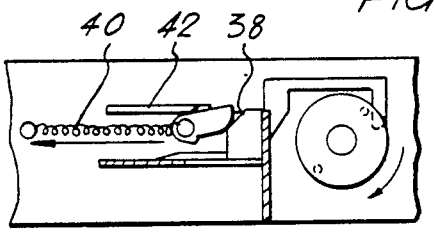
FIG. 4.
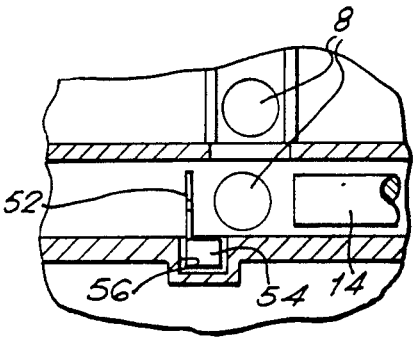

TOY GUNS FOR FIRING PELLETS

BACKGROUND AND SUMMARY OF THE INVENTION

This invention relates to pellet guns. A typical pellet gun has a delivery mechanism by which a pellet as required is fed into the path of an hammer which upon firing, propels it along the barrel for discharge. The hammer is activated by the trigger; the delivery mechanism can be a simple gravity feed. Pellets are normally stored in a magazine mounted on the body of the gun over the barrel.

The present invention is concerned with the provision of an automatic firing mechanism in a pellet gun and means for assuring proper sequential delivery of pellets to a firing position. A toy gun according to the invention has a barrel extending from a gun body; an hand grip attached to the body adjacent a trigger for actuating a firing mechanism mounted in the gun body; and means for delivering pellets seriatim to substantially the same point in the barrel for firing. The firing mechanism comprises a firing hammer reciprocally movable along the barrel post said point to strike and discharge a said pellet from the barrel in its forward stroke; resilient means continuously biasing the hammer to a forward position in the barrel; and a drive mechanism for cyclically withdrawing the hammer against the force of the resilient means and releasing same, the trigger being selectively operable to activate the drive means. The firing hammer is preferably resiliently biased by means of a leaf spring which extends through a slot in the barrel wall.

The preferred drive means comprises a cam follower reciprocally movable along a path parallel to the axis of the barrel, and pivotable between a first orientation in which it is coupled to the hammer to effect withdrawal thereof against the resilient means, and a second orientation at which the hammer is released; and a cam surface for pivotting the cam follower from its first to its second orientation with the hammer at a rearward position in the barrel. The cam follower may have a shoulder selectively engageable with the spring to effect withdrawal of the hammer.

In another preferred feature, the drive means comprises a rotatable pinion with at least one post mounted eccentrically thereon, said post engaging an arm to effect reciprocal movement thereof, the arm being coupled to the hammer to withdraw same against the force of the resilient means. The pinion may carry two posts mounted on a common diameter, the arm including a portion extending perpendicularly to the axis of the barrel, being movable parallel to said axis, and being continuously biased forwardly thereof. Alternate engagement of the posts with this portion cyclically withdraws the arm and hammer rearwardly with respect to the barrel. Typically, an electric motor powered from batteries in the gun provides the requisite continuous movement, the trigger operating an electric switch to actuate same.

In accordance with another preferred embodiment of the invention a toy gun for firing pellets has a barrel extending forwardly from a gun body; an hand grip attached to the body adjacent a trigger for actuating a firing mechanism mounted in the gun body; and a magazine for a supply of pellets comprising a plurality of discrete sections each for confining a column of pellets, the magazine being mounted on the body with the lower end of each section being closed by a surface on the gun body, the magazine being slideable with respect to the gun body to selectively locate the base of any one section over an aperture in the gun barrel and release pellets seriatim from a respective column to a firing point in the gun barrel, the firing mechanism including an hammer and drive means for cyclically advancing and retracting the hammer through said point to fire a pellet from the barrel.

In order to prevent forward movement of a pellet from the firing point in advance of impact with the hammer, resilient means may be included which are sufficient to restrain such movement but insufficient to impede passage of such a pellet after impact with the hammer. A gate coupled to movement of the hammer may perform the same function.

The invention offers a toy gun which can effectively simulate repeated fire of pellets using a simple mechanism which is either activated or dormant. The supply of pellets for firing is controlled, and the availability thereof made readily visable by the provision of a transparent plate covering one side of the magazine. The principle parts of the gun can be moulded in plastics materials, and manufacture and assembly is quite straight forward.

BRIEF DESCRIPTION OF THE DRAWING

Various features and advantages of the invention will be apparent from the following description of a preferred embodiment, in which reference will be made to the accompanying drawing. It will be understood that these features may be adopted in accordance with the invention both alone and in combination. In the drawing:

FIG. 1 is an elevation, partly broken away, of a gun according to the invention;

FIG. 2 is a detail sectional plan view (from below) showing the firing mechanism;

FIG. 3 is a view similar to that of FIG. 2, with the components of the mechanism in another orientation; and FIG. 4 is a detail view from FIG. 1 showing the barrel just forward of the firing hammer.

DESCRIPTION OF THE PREFERRED EMBODIMENT

The gun illustrated has a barrel 2 which extends into a body 4. The body 4 supports a magazine 6 holding pellets 8 for delivery seriatim to the barrel for firing, and houses a firing mechanism activated by a trigger 10. An hand grip 12 depends from the body behind the trigger.

A firing hammer 14 is disposed within the barrel 2 for reciprocal motion therealong, and as attached to the end of a leaf spring 16 which extends downwards through a slot in the barrel 2 in front of the trigger 10, and around a post 18 to a plate where its other end is secured. In the position shown in FIGS. 1 and 2, the spring 16 is held behind a shoulder 20 on a cam follower 22 which, as the gun is fired, withdraws and releases the spring to drive the hammer to strike and discharge a pellet 8 from the barrel 2.

The firing mechanism is actuated by the trigger 10 to continuously withdraw and release the spring 16 and hammer 14 to discharge successive pellets from the barrel as they are fed thereto. The trigger has a switch 24 which completes an electrical circuit from batteries 26 in the grip 12 to a motor 28 in the gun body 4. The motor is coupled to a gear train indicated at 30 to drive a pinion 32 which has posts 34 on a diameter thereof for alternate engagement of a reciprocating arm 36. At its distal end, the arm pivotally supports the cam follower 22.

The operation of the firing mechanism can best be seen from FIGS. 2 and 3. The orientation of the mechanism in FIG. 2 is the same as that of FIG. 1, with the reciprocating arm having been engaged by the post 34' in the commencement of its rearward movement. As the pinion continuous to rotate in the direction indicated, the rearward motion continues to the position shown in FIG. 3. At this stage, the cam follower 22 engages a wall 38 in the gun body 4, and is pivoted to release the spring 16 from its shoulder 20. As the pinion 32 further rotates, the post 34' releases the arm 36 which returns to a forward position under the action of a spring 40 attached to the pivot for the cam follower 22. As the cam follower moves forward, it reverts to its previous orientation by engagement with another wall 42 in the gun body 4 and re-engages the spring 16 at the latter's forward position against a stop 44. The follower 22 has a further cam surface which engages and displaces laterally the end of the spring 16 so that it can pass and relocate behind the shoulder 20.

The slight delay between release of the spring 16 by the cam follower 22, and release of the arm 36 by the pinion 32 is beneficial, as this ensures free passage for the hammer 14 and spring 16 prior to re-engagement of the spring 16 by the cam follower 22. It should also be noted that the arm 36 is released prior to the posts 34, 34' being aligned parallel to the gun barrel 2, enabling the arm 36 to return to its forward position prior to engagement by the post 34 after it passes the aligned orientation. The mechanism could of course operate with only a single post 34 on the pinion, if desired in continuous engagement with the arm 36, obviating the need for the return spring 40, but the provision of two posts as described facilitates rapid firing and reduces fluctuations in the loading of the motor 28.

The magazine 6 is mounted at the forward end of and protrudes into the gun body 4. It has five discrete columns 44 separated by walls 46. One side is closed by a removable transparent plate 48 which extends, in its closed position, only to the top of the body 4. To load the magazine, the gun is placed on its side, the plate 44 removed, and each column filled with pellets. The plate 48 is replaced, and the gun can then be carried in the hand for firing. The magazine is normally permanently attached to the gun body 4, but slideable along the body to locate any one of the columns 44 over an aperture 50 in the gun barrel 2. In one of these positions, the pellets in a column 44 are fed by gravity into the barrel 2. Just forward of the aperture (see FIG. 4) one or more resilient tongues or a lip 52 are mounted in the barrel 2 to prevent free movement of a pellet 8. The lip 52 extends from and is moulded integrally with a base 54 in PVC, the base being mounted in a recess 56 in the barrel wall. Upon firing, the lip 52 is distorted by the force of the hammer 14 as it advances past the aperture. There is normally no need to include tongues to prevent rearward motion of a pellet, although such may be included if desired. Alternatively a gate withdrawn by the advance of the hammer may perform the same function.

The presence of a pellet 8 in the barrel below the aperture 46 prevents premature delivery of a subsequent pellet. The hammer 14 passes below the aperture upon firing and itself prevents the delivery of a pellet until it is again withdrawn by the cam follower 22. Additionally, when the gun is not being fired, the hammer will come to rest under the aperture 46, by virtue of the spring 16. Thus, a pellet will only be admitted to the barrel while the gun is firing.

Although the magazine is illustrated as being an integral part of the game, it may be replaceable such that when empty, it may be replaced by a full or charged substitute.

I claim:

1. A toy gun for firing pellets having a barrel extending from a gun body; an hand grip attached to the body adjacent a trigger for actuating a firing mechanism mounted in the gun body; and means for delivering pellets seriatim to substantially the same point in the barrel for firing, the firing mechanism comprising a firing hammer reciprocally movable along the barrel post said point to strike and discharge a said pellet from the barrel in its forward stroke; resilient means continuously blasing the hammer to a forward position in the barrel; and a drive mechanism for cyclically withdrawing the hammer against the force of the resilient means and releasing same, which drive means comprises a cam follower reciprocally movable along a path parallel to the axis of the barrel, and pivotable between a first orientation in which it is coupled to the hammer to effect withdrawal thereof against the resilient means, and a second orientation at which the hammer is released; and a cam surface for pivotting the cam follower from its first to its second orientation with the hammer at a rearward position in the barrel, the trigger being selectively operable to activate the drive means.

2. A toy gun according to claim 1 wherein the resilient means is a leaf spring normally biased to a forward position against a stop, one end thereof extending through an axial slot in the barrel wall and being coupled to the hammer.

3. A toy gun according to claim 1 wherein the cam follower has a shoulder selectively engageable with the spring to effect withdrawal of the hammer.

4. A toy gun according to claim 1 or claim 3 wherein the cam follower is disposed for reciprocal movement along a path below the barrel.

5. A toy gun according to claim 1 wherein the drive means comprises a rotatable pinion with at least one post mounted eccentrically thereon, said post engaging an arm to effect reciprocal movement thereof, the arm being coupled to the hammer to withdraw same against the force of the resilient means.

6. A toy gun according to claim 5 wherein the pinion has two posts mounted on a common diameter, the arm including a portion extending perpendicularly to the axis of the barrel, being movable parallel to said axis, and being continuously biased forwardly thereof, alternate engagement of the posts with said portion cyclically withdrawing the arm and hammer rearwardly with respect to the barrel.

7. A toy gun according to claim 1 wherein the drive means comprises an electric motor, the trigger being coupled to an electrical switch for activating same.

8. A toy gun for firing pellets having a barrel extending forwardly from a gun body; an hand grip attached to the body adjacent a trigger for activating a firing mechanism; and means for delivering pellets seriatim to substantially the same point in the barrel for firing, the firing mechanism comprising a motor coupled through a gear train to drive a pinion bearing two posts eccentrically mounted on a common diameter thereof; an arm mounted for reciprocal motion parallel to the axis of the barrel; means continuously biasing the arm forwardly towards the distal end of the barrel, the arm having a portion extending perpendicularly to said barrel axis for alternate engagement with the posts as the pinion rotates, a post engaging said portion at the end of each forward stroke of the arm and releasing it at the end of each rearward stroke; a cam follower pivotally mounted on the forward end of the arm for selective coupling to a firing hammer to withdraw same in the rearward stroke of the arm, the gun body including a cam surface which pivots the follower at the end of the rearward stroke of the arm to release the hammer, and resilient means for urging the hammer upon such release along the barrel and through said point therein to engage and discharge a pellet thereat forwardly from the barrel.

9. A toy gun according to claim 8 wherein the cam surface on the gun body is so located with respect to the barrel axis as to ensure release of the hammer prior to release of the reciprocating arm by a post on the pinion.

10. A toy gun according to claim 1 or claim 8 wherein the firing hammer is continuously biased towards the forward end of the barrel, but has a limit position defined by a stop, at which position the hammer is located below an aperture in the gun wall and prevents the delivery of a pellet to said firing point in the barrel.

11. A toy gun according to claim 1 or claim 8 including resilient means on the wall of the barrel for preventing movement of a pellet forwardly from said firing point in advance of impact with the hammer.

12. A toy gun according to claim 11 wherein said resilient means comprises an elastic protrusion extending inwardly from the wall of the barrel.

* * * * *